US009096416B2

(12) United States Patent
Hoolahan

(10) Patent No.: US 9,096,416 B2
(45) Date of Patent: Aug. 4, 2015

(54) TOOL FOR REMOVING SHEATHING AND DECKING MATERIAL AND THE LIKE

(71) Applicant: Stephen Hoolahan, Massapequa, NY (US)

(72) Inventor: Stephen Hoolahan, Massapequa, NY (US)

( * ) Notice: Subject to any disclaimer, the term of this patent is extended or adjusted under 35 U.S.C. 154(b) by 156 days.

(21) Appl. No.: 14/027,358

(22) Filed: Sep. 16, 2013

(65) Prior Publication Data

US 2014/0034886 A1 Feb. 6, 2014

Related U.S. Application Data

(63) Continuation-in-part of application No. 12/587,540, filed on Oct. 8, 2009, now Pat. No. 8,534,163.

(60) Provisional application No. 61/195,682, filed on Oct. 9, 2008.

(51) Int. Cl.
*B66F 15/00* (2006.01)

(52) U.S. Cl.
CPC ..... *B66F 15/00* (2013.01)

(58) Field of Classification Search
CPC ..... B66F 15/00; A01B 1/02; A01B 1/022; A01B 1/024; A01B 1/028; A01B 1/04; E01H 5/02; Y10T 16/459
USPC ..... 294/58, 60; 29/267; 254/104, 131.5
See application file for complete search history.

(56) References Cited

U.S. PATENT DOCUMENTS

| | | | | | |
|---|---|---|---|---|---|
| 291,234 | A | * | 1/1884 | Sholder | 209/419 |
| 827,542 | A | * | 7/1906 | Lawson | 56/400.04 |
| 880,527 | A | * | 3/1908 | Hepp | 294/49 |
| 1,062,474 | A | | 5/1913 | Kelly | |
| 1,372,722 | A | * | 3/1921 | Paradis | 294/54.5 |
| 1,898,234 | A | | 2/1933 | Anderson | |
| 2,028,483 | A | * | 1/1936 | Van Yahres | 294/50.6 |
| 2,047,485 | A | | 7/1936 | McCbrady | |
| 2,891,813 | A | | 6/1959 | Inaki | |
| 3,202,120 | A | * | 8/1965 | Laffler | 111/96 |
| 3,226,149 | A | | 12/1965 | McJohnson | |
| 3,985,338 | A | | 10/1976 | Herrmann | |
| 4,198,090 | A | | 4/1980 | Gutman | |
| 4,466,188 | A | * | 8/1984 | Svendsgaard | 30/172 |
| 5,381,707 | A | | 1/1995 | Gill | |
| 5,495,781 | A | | 3/1996 | Wirth | |
| 5,503,445 | A | * | 4/1996 | Fontaine | 294/60 |
| 5,645,305 | A | * | 7/1997 | Lispi | 294/58 |
| 6,003,915 | A | | 12/1999 | Bierman | |
| 7,669,506 | B2 | * | 3/2010 | Cox | 81/45 |
| 8,079,290 | B2 | * | 12/2011 | Cox | 81/45 |
| 2002/0096395 | A1 | * | 7/2002 | Garrett | 182/45 |
| 2007/0108782 | A1 | * | 5/2007 | Walker et al. | 294/51 |
| 2007/0199412 | A1 | | 8/2007 | Lee | |

* cited by examiner

*Primary Examiner* — Lee D Wilson
*Assistant Examiner* — Joel Crandall
(74) *Attorney, Agent, or Firm* — Franco S. De Liguori; DP IP Group

(57) ABSTRACT

A tool for removing sheathing and decking material includes a head having a rear end, front end, a bottom wall, a pair of side walls having pairs of aligned holes, a rear wall connected to the bottom and side walls, a front wall extending between the bottom and side walls, an interior space defined by the bottom, side, rear and front walls, a support wall disposed in the interior space and extending between the side walls, and a tubular member integrally connected to the rear and support walls. A handle is configured to extend into and be removably connected to the tubular member of the head. A fulcrum member is selectively removably received by one of the pairs of aligned holes formed in the side walls of the head so that the fulcrum member extends in a preselected angular orientation relative to the handle during a removal operation.

20 Claims, 18 Drawing Sheets

TOOL FOR REMOVING SHEATHING AND DECKING MATERIAL AND THE LIKE

CROSS-REFERENCE TO RELATED APPLICATIONS

This application is a continuation-in-part of patent application Ser. No. 12/587,540, filed Oct. 8, 2009, which claims priority benefit of Provisional Application No. 61/195,682, filed Oct. 9, 2008.

BACKGROUND OF THE INVENTION

1. Field of the Invention

The present invention relates to construction equipment, and more specifically relates to manual, hand-held tools used in the housing industry for removing sheathing, decking and the like from existing structures.

2. Background Information

For refurbishing existing building structures, very often it is necessary to remove sheathing and decking material from the structure. The sheathing and decking material is usually fastened to and supported by spaced apart joists.

Various tools and devices have been provided for removing old sheathing and decking material preparatory to the installation of new replacement sheathing and shingle material.

A common method of removing such sheathing and decking material is to use a crowbar or the like. This is a manually exhaustive and time consuming operation. Furthermore, there is very little mechanical advantage in using a crowbar to remove such sheathing and decking material. Such a conventional method may result in muscle strain or even back injury.

Other removing tools include generally planar work-engaging heads carried by elongated handles which may be manually manipulated to drive the planar heads beneath sheathing and decking material for the purpose of severing the nails which secure the same to an existing structure. In addition, the handles are supported from the planar heads at an angle whereby the handles may be used as a lever in order to pry shingles from a roof. However, many roofing removing tools of this type are less efficient than desired for various reasons.

Accordingly, inasmuch as the removal of sheathing and decking material is a difficult, tiring and dangerous task, a need exists for a sheathing and decking removing tool which will enable a contractor to remove the sheathing and decking material in a more efficient, less tiring and safer manner.

The present invention addresses these problems and disadvantages of the conventional method of removing sheathing and decking material in refurbishing a building.

SUMMARY OF THE INVENTION

It is an object of the present invention is to provide tool for removing sheathing and decking material and the like in an efficient and safe manner.

It is another object of the present invention to provide a tool for removing sheathing and decking material and the like with high mechanical advantage so as to allow the removal of such materials from a building construction quickly and easily, and without requiring any excessive force.

It is another object of the present invention to provide a tool for removing sheathing and decking material and the like that eliminates any muscle strain or back injury to the user of the tool which may have otherwise resulted from conventional methods and equipment.

Still another object of the present invention is to provide a tool for removing sheathing and decking material and the like which may be readily wedged beneath such material and utilized to pry such material for removal thereof from existing building structures.

Yet another object of the present invention is to provide a tool for removing sheathing and decking material and the like which is simple in construction, economical to manufacture and easy to use so as to provide a tool that will be economically feasible, long lasting and relatively trouble free in operation.

The foregoing and other objects of the present invention are carried out by a tool for removing sheathing and decking material. The tool includes a head having a rear end, front end, a bottom wall, a pair of opposite lateral side walls connected to and extending from opposite edges of the bottom wall and having a plurality of pairs of aligned holes, a rear wall disposed at the rear end and connected to the bottom wall and the side walls, a front wall disposed at the front end and connected to and extending between the bottom wall and the side walls, an interior space defined by the bottom, side, rear and front walls, a support wall disposed in the interior space and extending between and connected at opposite edges thereof to the side walls, and a tubular member integrally connected to the rear wall and the support wall. A handle is configured to extend into and be removably connected to the tubular member of the head. A fulcrum member is configured to be selectively removably received by one of the plurality of pairs of aligned holes formed in the side walls of the head so that the fulcrum member extends in a preselected angular orientation relative to the handle during a removal operation.

In an exemplary embodiment, the side walls have first edges sloped from the support wall downwardly towards the front wall, and second edges sloped from the support wall downwardly toward the back wall. The pairs of aligned holes are disposed generally parallel to the second edges of the side walls. In another exemplary embodiment, protrusions are formed on the bottom wall of the head for providing a gripping surface for gripping the material to be removed during a removal operation. In yet another exemplary embodiment, gripping members are formed on the bottom wall of the head and have respective protruding portions configured to facilitate gripping of the material during a removal operation.

A tool according to another embodiment of the present invention comprises a head having a rear end, front end, a bottom wall, a pair of opposite lateral side walls connected to and extending from opposite edges of the bottom wall, a rear wall disposed at the rear end and connected to the bottom wall and the side walls, a front wall disposed at the front end and connected to and extending between the bottom wall and the side walls, an interior space defined by the bottom, side, rear and front walls, a support wall disposed in the interior space and extending between and connected at opposite edges thereof to the side walls, and a tubular member integrally connected to the rear wall and the support wall. A first set of pairs of aligned holes are formed in the side walls and extending along upper edges of the side walls. A second set of pairs of aligned holes are formed in the side walls and extending along the bottom wall. A handle is configured to extend into and be removably connected to the tubular member of the head. A fulcrum member is configured to be selectively removably received by one of the pairs of aligned holes of one of the first and second sets of plural pairs of aligned holes formed in the side walls of the head so that the fulcrum member extends in a preselected angular orientation relative to the handle during a removal operation.

In another aspect, the present invention provides a ripping attachment configured for integral removal connection to the head of the tool according to any of the foregoing aspects of the invention for ripping material during a removal operation. The ripping attachment has relief holes configured to receive the respective protruding portions of the gripping members when the ripping attachment is mounted to the head, and a ripping edge for ripping material during a removal operation. The ripping attachment is formed of a pair of flat plates integrally connected together, a base portion from which the ripping edge extends, and a hook portion extending from the base portion and configured for engagement with the front wall of remover. One of the pair of flat plates has the relief holes and the other of the pair of flat plates has at least one connecting element configured for connection to another connecting element to integrally removably mount the ripping attachment to the head.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIG. 14 is a partial diagrammatic view showing the tool according to the second embodiment during removal of sheathing and decking material and the like;

DETAILED DESCRIPTION OF THE INVENTION

Figure 1:
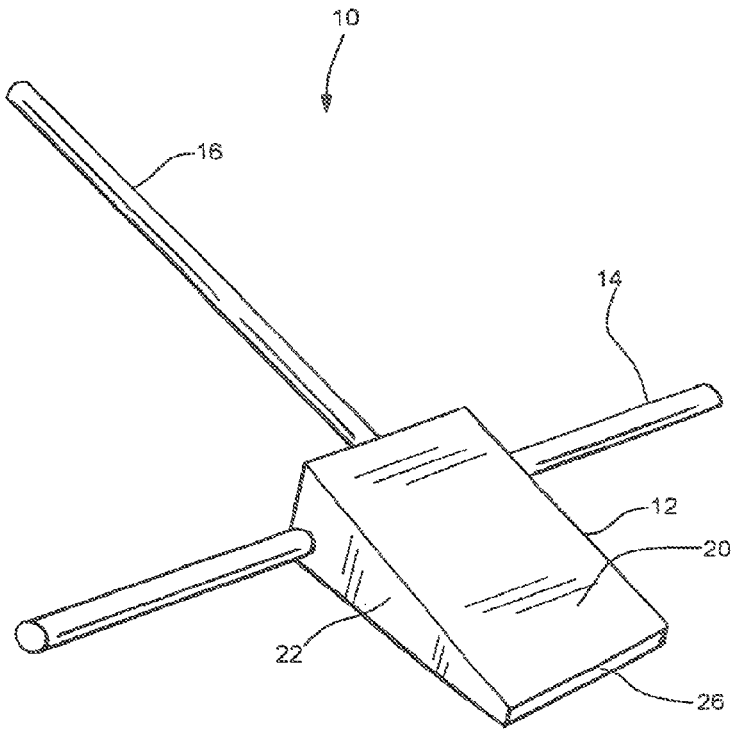
FIG. 1 is a perspective view of the tool for removing sheathing and decking material and the like in accordance with a first embodiment of the present invention illustrating the orientation of the tool during use.

While this invention is susceptible of embodiments in many different forms, this specification and the accompanying drawings disclose only presently preferred embodiments of the invention. The invention is not intended to be limited to the embodiments so described, and the scope of the invention will be pointed out in the appended claims.

Certain terminology is used in the following description for convenience only and is not intended to be limiting. The words right, left, front, top, rear, back, upper, lower, inner, outer, rearwardly and forwardly designate directions in the drawing to which reference is made. Such terminology includes the words above specifically mentioned and words of similar import.

In the following description of the preferred embodiments of the present invention, the term "about" is used to quantify the preferred dimensions and weights of the tool and its components. The term "about" is defined to cover the specific dimensions and weights described as well as values within a range of ±10% of the specific dimensions and weights described.

The preferred embodiments of the tool according to the present invention is described below with a specific application to removing sheathing and decking material and the like. However, it will be appreciated by those of ordinary skill in the art that the tool of the present invention is also specifically well adapted for removal of other related or different types of flooring materials (i.e., hardwood floors) and roof covering materials (e.g., shingles, felt, tar paper), for example.

Referring now to the drawings in detail, wherein like numerals are used to indicate like elements throughout, there is shown in FIGS. 1-7 exemplary embodiments of a tool for removing sheathing and decking material and the like (hereinafter "remover"), generally designated at 10, according to the present invention. The remover 10 includes a head or pry box 12 having a side wall opening (first opening) 12*a*, a pair of aligned side wall openings (second openings) 12*b* and an upstanding reinforcing support wall 13, a fulcrum member in the form of a crossbar 14 configured for passing through the pair of side wall openings 12*b* of the pry box 12 for providing a fulcrum during use of the remover 10, and an elongated handle 16 passing through the side wall opening 12*a* of the pry box 12 and affixed at an axial end (base end portion) thereof to the support wall 13 so as to be generally transverse to the crossbar 14. In the exemplary embodiment, the handle 16 is generally perpendicular to the crossbar 14. However, it will be appreciated that other angular relationships are suitable between the crossbar 14 and the handle 16 without departing from the spirit and scope of the present invention.

The pry box 12 includes a front end, a rear end, a top end and a bottom end opposite the top end. The bottom end is closed by a bottom wall having a plurality of side walls defining an open, generally wedge-shaped box structure that is open at the top end of the pry box 12 to provide a cavity or interior space 18. More specifically, the pry box 12 includes a bottom wall 20, a pair of opposite lateral side walls 22 (left and right side walls as viewed in FIG. 2) connected or joined to and extending from opposite edges of the bottom wall 20, a rear or back wall 24 at the rear end joined to the bottom wall 18 and the lateral side walls 22, and a short front wall 26 at the front end defining a narrow shovel nose, which also extends between the bottom wall 18 and the lateral side walls 22 and which is positioned opposite the back wall 24.

Referring to FIGS. 1, 2, 4 and 5, the back wall 24 is greater in height than the front wall 26 so that upper or top edges 22*a* of the side walls 22 are sloped from the back wall 24 downwardly towards the front wall 26 to provide the pry box 2 with its wedge shape. Situated within the cavity or interior space 18 of the pry box 12 is the upstanding support wall 13 which extends between the side walls 22 and which is preferably parallel with the back wall 24 and the front wall 26. The support wall 13 is preferably positioned about midway between the back wall 24 and the front wall 26, and provides strength to the pry box 2 with minimal additional weight. The support wall 13 is integrally secured to the bottom wall 20 and the side walls 22, such as by weld 28. It is understood, however, that other forms of integral connection between the support wall 13 and the bottom wall 20 are suitable, including various types of fasteners.

Figure 2:
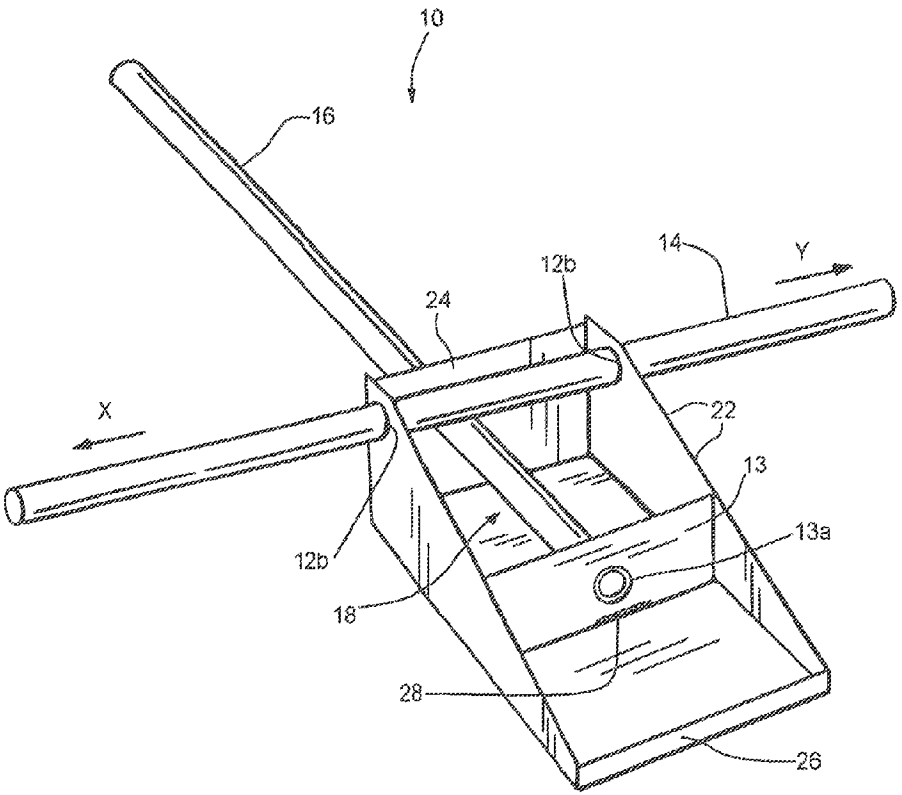
FIG. 2 is another perspective view of the tool in accordance with the first embodiment of the present invention, with the depressible protrusions of the fulcrum member omitted for simplicity of explanation only.
Figure 3:
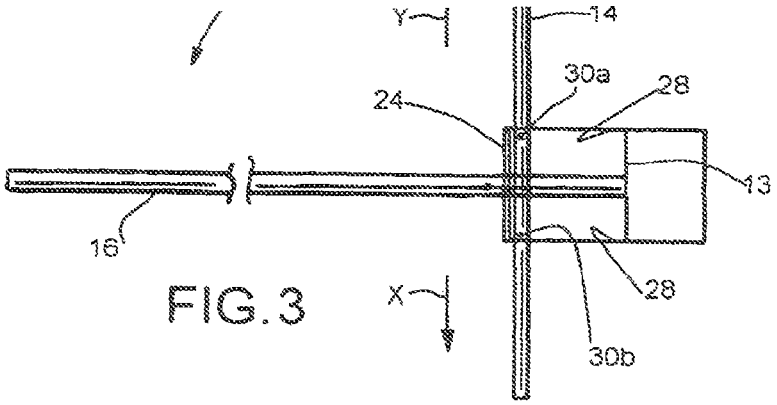
FIG. 3 is a top plan view of the tool in accordance with the first embodiment of the present invention.
Figure 4:
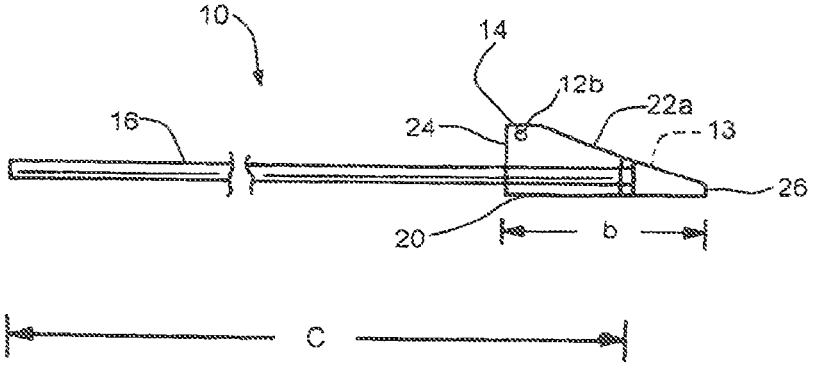
FIG. 4 is a side elevational view of the tool in accordance with the first embodiment of the present invention.
Figure 5:
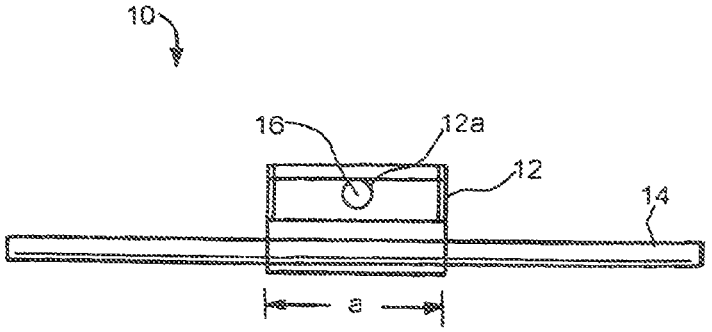
FIG. 5 is a front elevational view of the tool in accordance with the first embodiment of the present invention.

As best shown in FIGS. 2 and 4, the side wall openings 12*b* of the pry box 12 are formed through the thickness of the opposite side walls 22 and are preferably situated near or at the juncture between the side walls 22 and the back wall 24. The side wall openings 12*b* are provided in the side walls 22 to removably receive the crossbar 14 which, as shown in FIGS. 1-4, is passed through the side wall openings 12*b* and the cavity or interior space 18 of the pry box 12 to act as a fulcrum during operation of the remover as further described below. The crossbar 14 is preferably hollow and tubular in form to minimize the overall weight of the sheathing and decking remover 10, and yet is formed with a diameter and thickness which are sufficient to provide the remover with the required strength for removing sheathing and decking material from a building structure. In the exemplary embodiment, the side wall openings 12*b* of the pry box 12 are generally circular-shaped to receive therethrough the tubular crossbar 14 of similar circular-shaped cross-section. It will be appreciated, however, that other shapes and cross-sections are suitable for the side wall openings 12*b* and the tubular crossbar 14, such as oval, rectangular, triangular, hexagon, octagon, or other suitable shapes and cross-sections.

Figure 6:
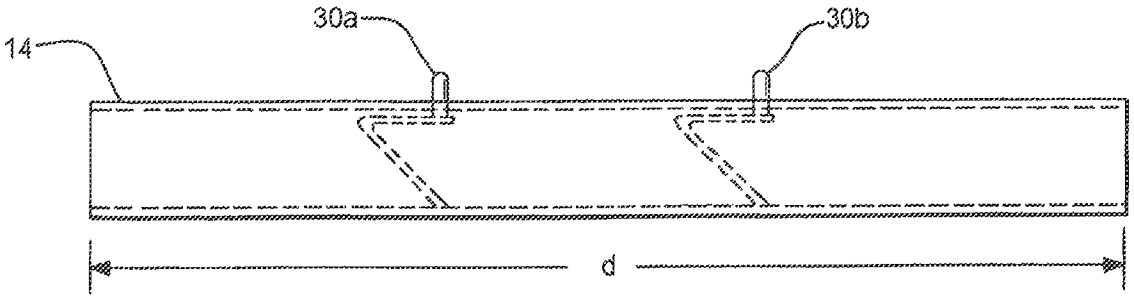
FIG. 6 is a side view of the fulcrum member of the tool in accordance with the present invention.

Referring to FIG. 6, the tubular crossbar 14 preferably includes spring loaded depressible protrusions 30*a*, 30*b* selectively projecting from the outer surface of the crossbar 14 and formed through the thickness of the crossbar and spaced apart from one another a predetermined distance which may be slightly greater than or slightly less than the width of the wedge-shaped pry box 12 so that, when the crossbar 14 is inserted into the side wall openings 12*b* of the pry box 12, the depressible protrusions 30*a*, 30*b* engage the respective side walls 22 to prevent relative lateral or transverse movement of the crossbar 14 relative to the pry box 12, as shown in FIGS. 1 and 2 (in FIG. 2 the depressible protrusions 30*a*, 30*b* have been omitted for simplicity of explanation only). Thus the depressible protrusions 30*a*, 30*b* define means for preventing movement of the crossbar 14 in the direction generally transverse to the handle 16. It will be appreciated by those skilled in the art that the means for preventing movement is not limited to spring loaded depressible protrusions. For example, cotter pins of high grade material extending through-holes formed in the crossbar 14 for engagement with the side walls 22 of the pry box 12 are also suitable for preventing movement of the crossbar 14 in the direction generally transverse to the handle 16.

The position of the crossbar 14 shown in FIGS. 1 and 2 is a first position of the crossbar 14 relative to the pry box 12. Another function of the depressible protrusions 30*a*, 30*b* is to permit adjustment of the position of the crossbar 14 in two additional positions (e.g., second and third positions, not shown) relative to the pry box 12 by displacing or moving the crossbar in left and right directions relative to the handle 16, as denoted by arrows X and Y, respectively, in FIGS. 1 and 2. For example, the second position of the crossbar 14 relative to the pry box 12 is achieved by depressing the protrusion 30*b* and displacing the crossbar 14 in the direction of arrow X until the protrusion 30*a* abuts the inner surface of the left side wall 22. The third position of the crossbar 14 relative to the pry box 12 is achieved by depressing the protrusion 30*a* and displacing the crossbar 14 in the direction of arrow Y until the protrusion 30*b* abuts the inner surface of the right side wall 22. In the second and third positions of the crossbar 14 relative to the pry box 12, the utility of the remover 10 is increased by permitting the remover to remove sheathing and decking materials from areas of a deck or sheathing which are difficult to reach (e.g., corners and/or other confined areas) in the first position of the crossbar 14 relative to the pry box 12, as shown in FIG. 1-2. Thus, the depressible protrusions 30*a*, 30*b* of the crossbar 14 and the side wall openings 12*b* of the side walls 22 define adjusting means for adjusting a position of the crossbar 14 in directions generally transverse to the handle 16 (i.e., in directions along a length or longitudinal axis of the crossbar 14). It will be appreciated by those skilled in the art, that in each of the foregoing first, second and third positions of the crossbar 14, the construction and positional relationship of the components allow for ergonomic positioning of the handle 16 and the crossbar 14 to achieve the required fulcrum during use of the remover 10.

The side wall opening 12*a* is formed through the thickness of the back wall 24 of the pry box 12. The elongated handle 16 passes through the side wall opening 12*a* and is affixed at the axial end thereof to the support wall 13 such as by welding or other integral form of connection, such by removable fasteners. The support wall 13 has an opening 13*a* that receives the axial end of the handle 16 which is secured thereto by welding, for example. The elongated handle 16 is preferably hollow and tubular in form to minimize the overall weight of the sheathing and decking remover 10, and yet is formed with a diameter and thickness which are sufficient to provide the remover with the required strength during removal of sheathing and decking material from a building structure. In the exemplary embodiment, the side wall opening 12*a* of the pry box 12 is generally circular-shaped to receive therethrough the tubular handle 16 of similar circular-shaped cross-section. It will be appreciated, however, that other shapes and cross-sections are suitable for the side wall opening 12*a* and the tubular handle 16, as described above for the side wall openings 12*b* and the tubular crossbar 14.

Figure 7:
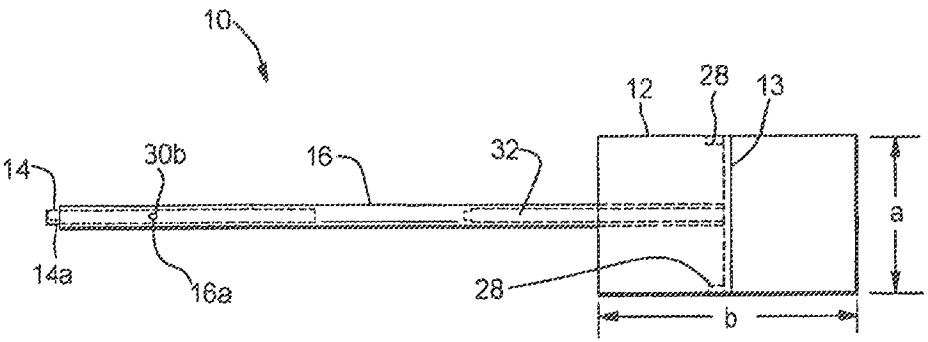
FIG. 7 is a top plan view showing modified embodiments of the tool in accordance with the present invention.
Figure 8:
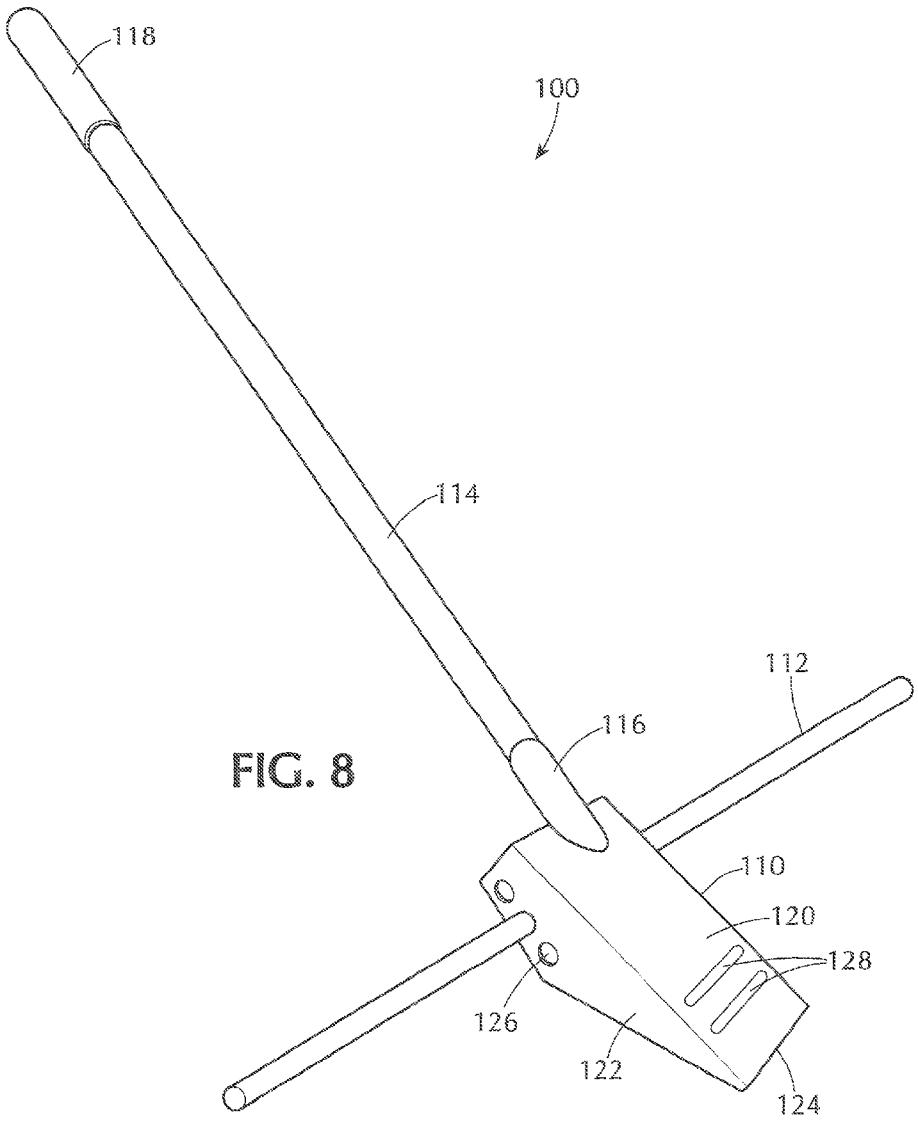
FIG. 8 is a perspective view of the tool for removing sheathing and decking material and the like in accordance with a second embodiment of the present invention illustrating the orientation of the tool during use.

The tubular handle 16 is relatively long, that is, preferably on the order of six or seven feet, for example, to provide maximum mechanical advantage for the user of the sheathing and decking remover 10, yet not so long that the remover becomes unwieldy to handle or cumbersome to store. Preferably, as shown in FIG. 7, the outer diameter of the tubular crossbar 14 is less than the inner diameter of the tubular handle 16 so that, when the remover 10 is not being used, the crossbar 14 may be removed therefrom and stored within the bore of the tubular handle 16, thereby reducing the overall width of the sheathing and decking remover 10 and increasing the storage capability of the remover 10. In the stored configuration, the crossbar 14 is supported within the bore of the tubular handle 16 by engagement between one of the depressible protrusions 30*a*, 30*b* with an opening 16*a* of the tubular handle 16, with a portion 14*a* of the crossbar 14 extending from an axial free end (free end portion) of the tubular handle 16. In FIG. 7, the depressible protrusion 30*b* engages the opening 16*a* of the tubular handle 16. The crossbar 14 is removed from the bore of the tubular handle 16 by depressing the depressible protrusion 30*b* and pulling the crossbar 14 outwardly from the portion 14*a* of the crossbar 14. Thus the bore of the handle 16 and the engagement between the depressible protrusion 30*a* or 30*b* of the crossbar 14 and the opening 16*a* of the handle 16 define means for storing the crossbar 14 during non-use of the remover 10. By this construction and corresponding functions, the present invention provides a remover that can be stored in the bore of the handle and which is readily accessible and movable from a storage position, during non-use of the remover, to a fulcrum generating or action position ready for performing a removal operation as further described below.

FIG. 7 shows another exemplary embodiment of the sheathing and decking remover 10 according to the present invention. In this exemplary embodiment, a weight member 32 is inserted into the bore of the tubular handle 16 so as to extend to the axial end thereof that is affixed to the support wall 24 of the pry box 12. The weight body or member 32 is preferably retained within the bore of the tubular handle 16 by friction fit, or other equivalent manner, and may be solid or tubular in construction. The purpose of the weight member 32 is to add weight to the remover 10 at the area of intersection between the tubular handle 16 and the pry box 12 in order to increase the mechanical advantage during use of the remover 10 to enable a removal operation without requiring any excessive force. Preferably, the overall weight of the remover 10 is in the range of about 13 pounds to about 17 pounds, and more preferably about 15 pounds, with the weight member 32 preferably representing from about 1 pound to about 3 pounds, and more preferably 3 pounds, of the overall weight of the remover 10.

FIGS. 6-7 show preferred dimensions for the pry box 12, the crossbar 14 and the handle 16. The overall width or outer lateral dimension a of the pry box 12 is selected so that it may fit between the space provided between adjacent joists in most residential and commercial constructions. Oftentimes, joists are spaced apart twelve, sixteen or twenty-four inches on center. Therefore, the preferred outer lateral dimension of the pry box 12 of the remover 10 is preferably in the range of about 8.75 inches to 10.75 inches, and more preferably about 9.75 inches. The length b of the pry box 12 is selected in proportion to the overall width a, and is preferably in the range of about 15 inches to 17 inches, and more preferably about 16 inches. Similar concerns are taken into account when choosing the length of the tubular crossbar 14, so that the crossbar 14 may rest on at least two adjacent joists, or more joists during use. Preferably, the length c of the crossbar 14 is in the range of about 39 inches to about 41 inches, and more preferably about 40 inches. The length d of the handle 16 is selected in proportion to the foregoing selected dimensions a, b and c, and is preferably in the range of about 71 inches to 73 inches, and more preferably about 72 inches. The length of the weight member 32 is preferably in the range of about 23 inches to 25 inches, and more preferably 24 inches.

The pry box 12 is formed of sheet metal or the like and is preferably hollow to decrease the weight thereof. The sheet metal forming the pry box 12 may be formed from aluminum, such as light weight aircraft aluminum, or other material. When formed from aluminum, the pry box 12 is preferably about 0.25 inches in thickness to provide sufficient rigidity and strength to the pry box 12.

Preferably, the tubular crossbar 14 is formed of a high grade steel and the tubular handle 16 and weight member 32 are formed of aluminum. It is understood, however, that other materials are suitable for the tubular crossbar 14, tubular handle 16 and weight member 32, including but not limited to titanium, and alloys of steel, aluminum and titanium.

During an operation of the remover 10 to remove sheathing, decking or the like from a building construction, the handle 16 is manipulated by an operator to position the remover 10 such that the pry box 12, in the orientation shown in FIG. 1, is situated between adjacent joists supporting the deck or sheathing with the crossbar 14 being oriented perpendicularly to the running direction of the joints and resting on the surface of the joists which support the sheathing or decking. The front wall 26 (i.e., the narrow shovel nose) of the pry box 12 is inserted at an angle underneath the sheathing or decking to be removed, with the handle 16 being disposed in a raised, angular position with respect to the plane in which the decking or sheathing resides. The operator then pushes down on the axial free end of the handle 16 opposite the pry box 12 to cause the pry box 12 to pivot upwardly against the bottom of the sheathing or decking attached to the joists, with the crossbar 14 acting as a fulcrum. The pry box 12 forces the sheathing or decking to lift off the supporting joists on which it is attached. The remover 10 is then advanced on the spaced apart joists to the next adjacent sheathing or decking, and the lifting operation is repeated. Preferably, the remover 10 is then repositioned between the next adjacent pair of joists and the operation is repeated until all of the sheathing or decking has been removed.

FIGS. 8-14 show another embodiment of the tool (remover) for removing sheathing and decking material and the like generally designated at 100, according to the present invention. The remover 100 is similar to the remover 10 described above with reference to FIGS. 1-7, with certain structural and functional differences as further described below. The materials and dimensions of the remover 100 are as described above for the remover 10.

The remover 100 includes a head or pry box 110 having a plurality of walls connected together to form an open, generally wedge-shaped box structure having a cavity or interior space 134 defined by the walls. More specifically, the pry box includes a lower or bottom wall 120, a pair of opposite lateral side walls 122 (left and right side walls as viewed in FIG. 9) connected or joined to and extending from opposite edges of a bottom wall 120, a rear or back wall 132 at a rear end joined to the bottom wall 120 and the lateral side walls 122, and a front wall 124 defining a narrow shovel nose or ripping edge, which also extends between the bottom wall 120 and the lateral side walls 122 and which is positioned opposite the back wall 132. The bottom wall 120 is provided with protrusions 128 forming gripping surfaces which facilitate gripping of the sheathing or decking material during a removal operation of the tool 100. An upstanding reinforcing support wall 130 extends between the side walls 122 and is integrally connected (e.g., by soldering or suitable fasteners) to the side walls 122 and the bottom wall 120.

Situated within the cavity or interior space 134 of the pry box 110 is an upstanding reinforcing support wall 130 which extends between the side walls 122 and which is preferably parallel with the back wall 132 and the front wall 124. The support wall 130 provides strength to the pry box 110 with minimal additional weight. The support wall 130 is integrally secured to the bottom wall 120 and the side walls 122, such as by welding. It is understood, however, that other forms of integral connection between the support wall 130, side walls 122 and bottom wall 120 are suitable, including various types of fasteners.

Figure 10:
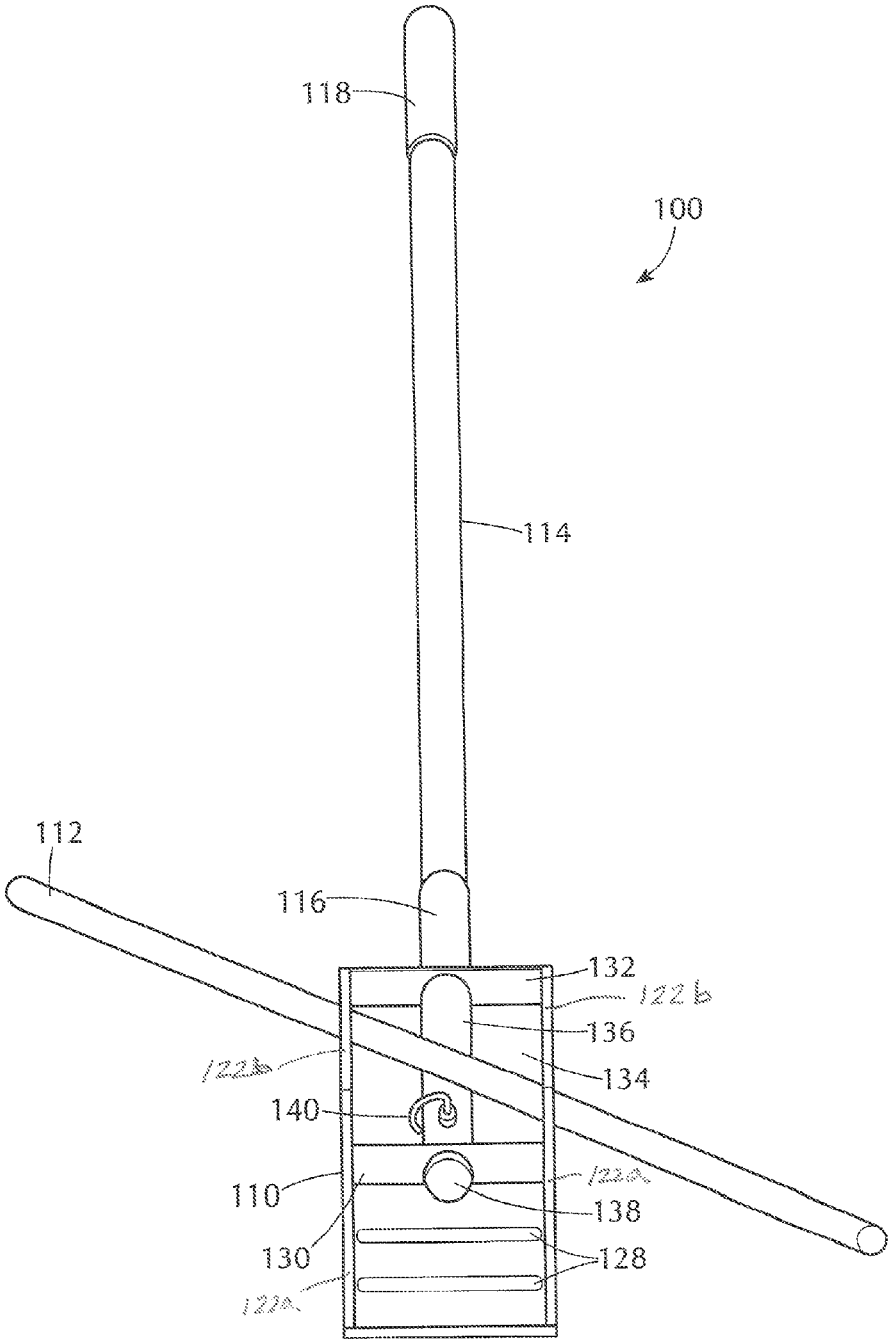
FIG. 10 is a rear elevational view of the tool according to the second embodiment, with the crossbar being positioned in a different orientation relative to the pry box than in FIGS. 8 and 9.
Figure 12:
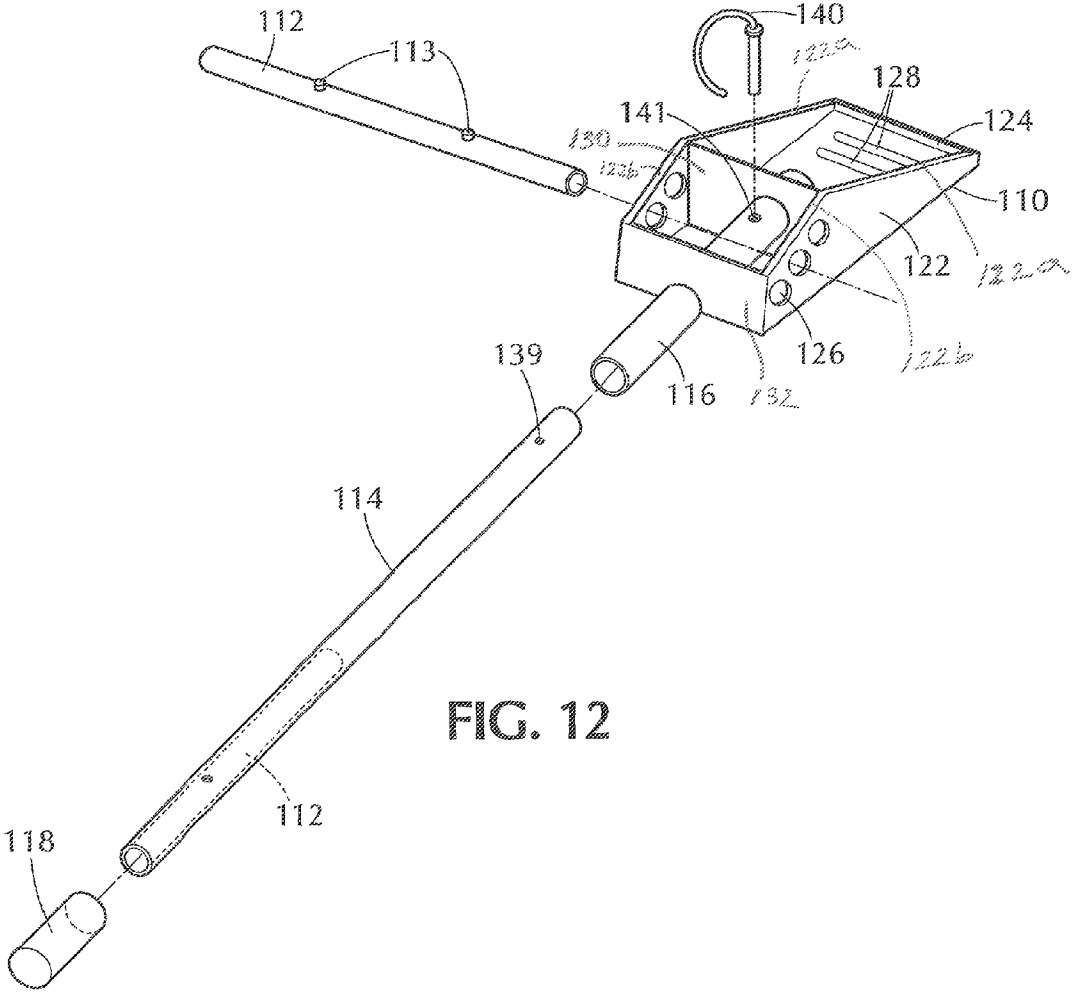
FIG. 12 is an exploded view of the tool according to the second embodiment.
Figure 13:
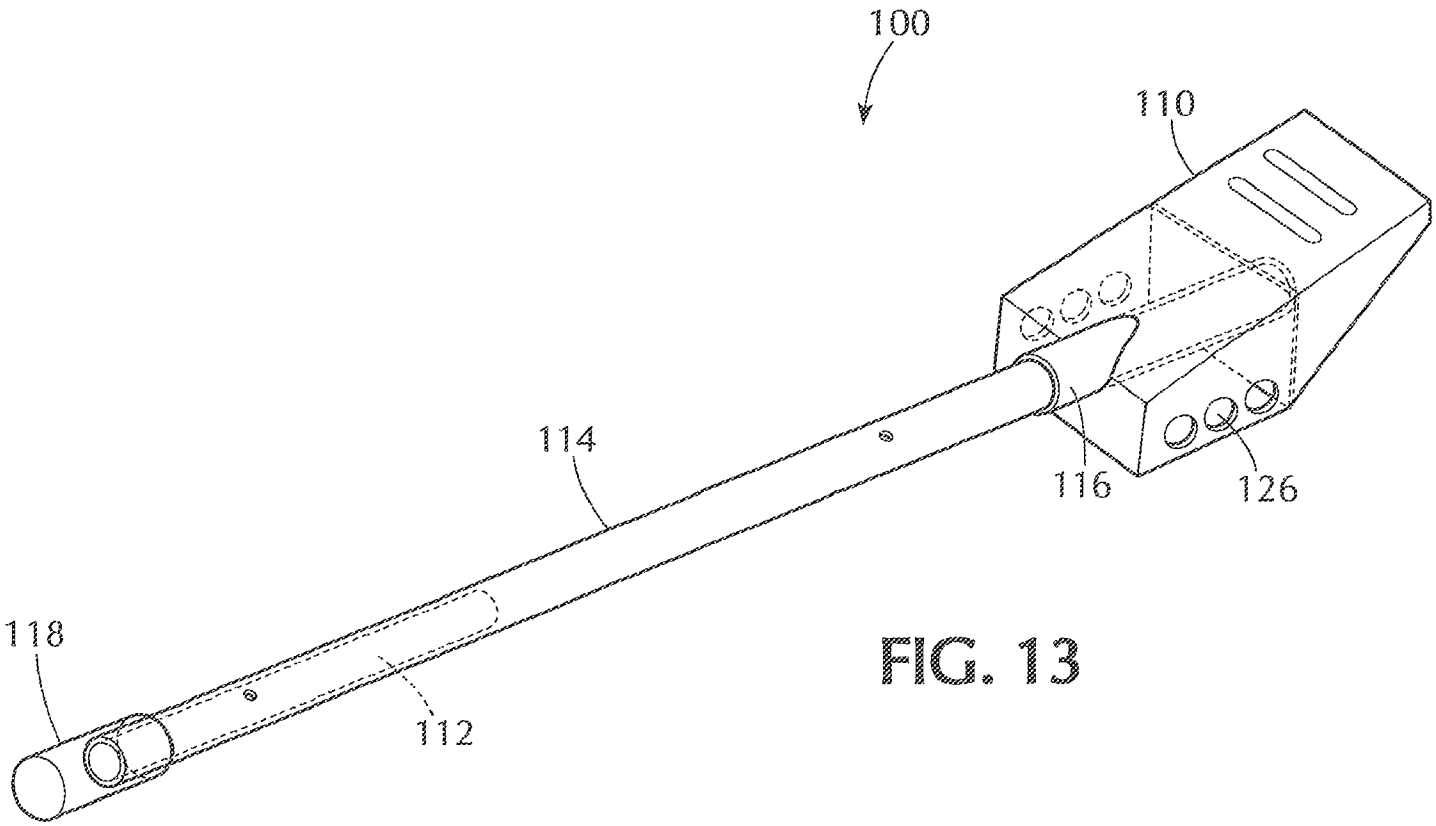
FIG. 13 is a perspective n exploded view of the tool according to the second embodiment.

Referring to FIGS. 10 and 12, the back wall 132 is greater in height than the front wall 124. Upper or top edges 122*a* (first edges) of the side walls 122 are sloped from the support wall 130 downwardly towards the front wall 124. Upper or top edges 122*b* (second edges) of the side walls 122 are sloped from the support wall 130 downwardly toward the back wall. By this construction, the pry box 110 is provided with its general wedge shape configuration.

A tubular member 116 extends through openings formed at portions of the back wall 132 and the bottom wall 120, and a front end portion 138 of the tubular member extends through an opening formed in the support wall 130, with a section 136 of the tubular member 116 extending between the back wall 132 and the support wall 130. The tubular member 116 is integrally connected to back wall 132, bottom wall 120 and support wall 130, such as by soldering or other suitable fastening means, and is configured to receive and integrally support an elongated handle 114 of remover 100, as further described below.

Figure 11:
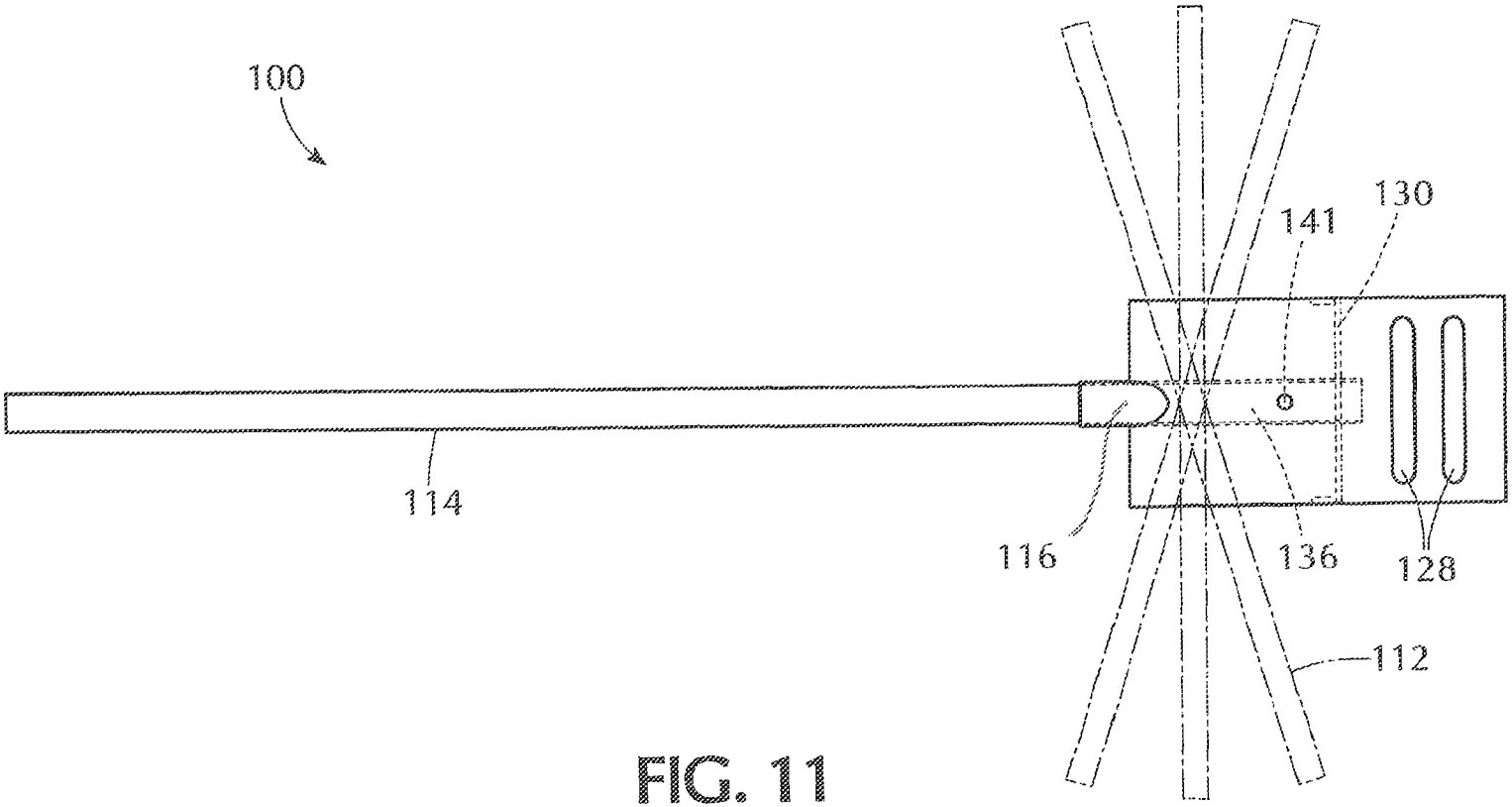
FIG. 11 is a rear view of the tool according to the second embodiment, showing various orientations of the crossbar (shown in relative to the pry box.

Referring to FIGS. 8 and 11-13, the pry box 110 has multiple pairs of aligned openings or holes 126 (first set of aligned openings) formed on side walls 122. The side wall openings 126 are formed through the thickness of the opposite side walls 122 and are preferably situated near or at the juncture between the side walls 122 and the back wall 132. In this exemplary embodiment, the first set of aligned openings 126 are formed on the side walls 122 so as to be generally parallel to the second edges of the side walls 122. The side wall openings 126 are provided in the side walls 122 to removably receive fulcrum member in the form a crossbar 112, which, as shown in FIG. 10, is selectively passed through one of the pairs of the side wall openings 122 and the cavity or interior space 134 of the pry box 110 to act as a fulcrum during operation of the remover in a manner similar as described above for the embodiment of FIGS. 1-7. FIG. 11 shows some of the various configurations for the crossbar 112 extending through the aligned openings 126.

The crossbar 112 is preferably hollow and tubular in form to minimize the overall weight of the sheathing and decking remover 100, and yet is formed with a diameter and thickness which are sufficient to provide the remover with the required strength for removing sheathing and decking material from a building structure. The side wall openings 126 are positioned on the side walls 122 so that the crossbar 112 is disposed over the section 136 of the tubular member 116 in the assembled configuration and orientation of the remover 100 shown in FIG. 10.

Figure 9:
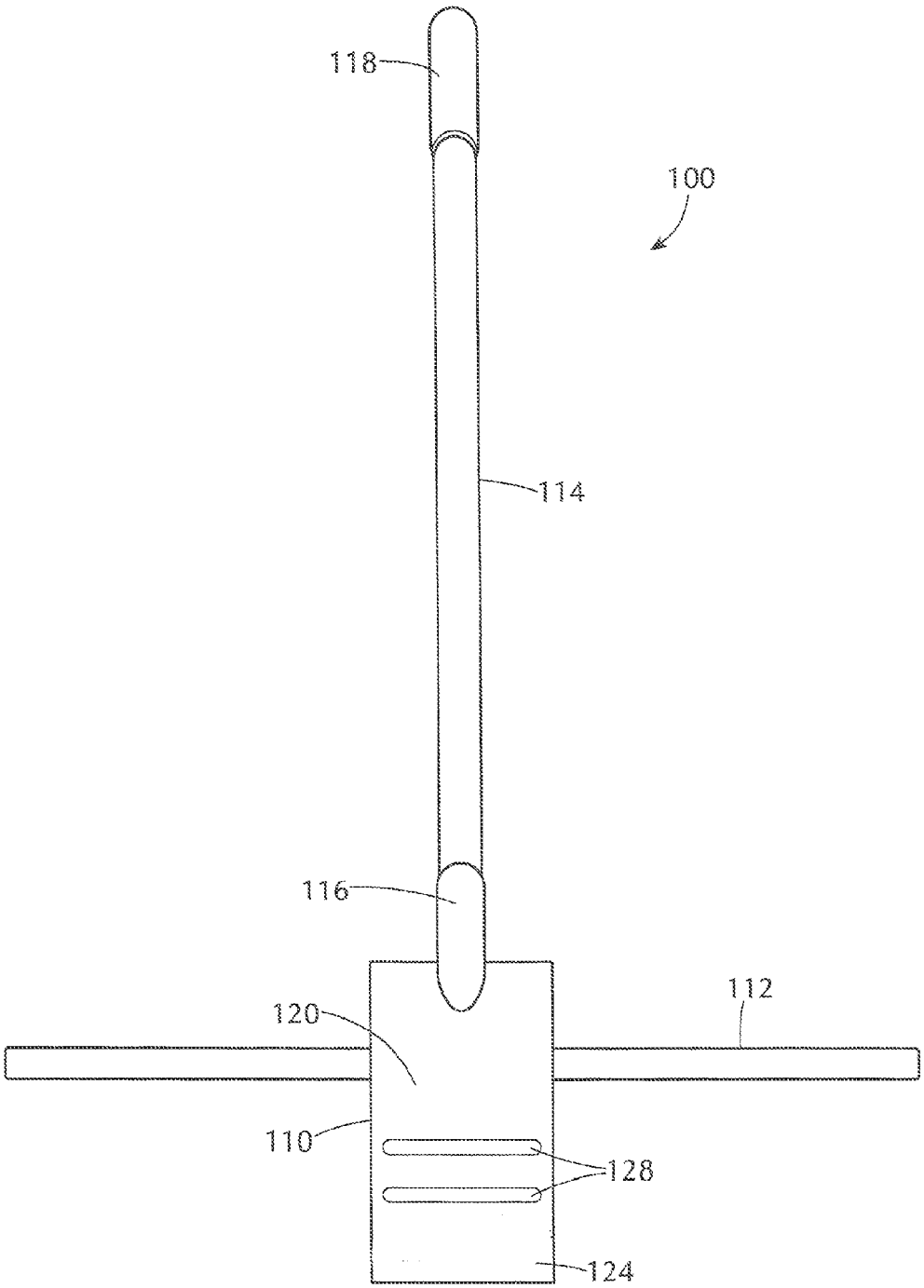
FIG. 9 is a front elevational view of the tool according to the second embodiment.

Referring to FIG. 12, the crossbar 112 preferably includes spring loaded depressible protrusions 113 selectively projecting from the outer surface of the crossbar 112 and formed through the thickness of the crossbar and spaced apart from one another a predetermined distance which may be slightly greater than or slightly less than the width of the pry box 110 so that, when the crossbar 112 is inserted into the aligned side wall openings 122 of the pry box 110, the depressible protrusions 113 engage the respective side walls 122 to prevent relative lateral or transverse movement of the crossbar 112 relative to the pry box 110. In FIGS. 9, 10 and 11 the depressible protrusions 133 have been omitted for simplicity of explanation only. Thus the depressible protrusions 133 define means for preventing movement of the crossbar 112 in the longitudinal direction of the crossbar 112. It will be appreciated by those skilled in the art that the means for preventing movement is not limited to spring loaded depressible protrusions. For example, cotter pins of high grade material extending in through-holes formed in the crossbar 112 for engagement with the side walls 122 of the pry box 110 are also suitable for preventing movement of the crossbar 112 in the longitudinal direction thereof.

In the exemplary embodiment shown in FIGS. 8-14, three side wall openings 126 are formed in each of the side walls 122, and each of the side wall openings 126 is generally circular-shaped to receive therethrough the tubular crossbar 112 of similar circular-shaped cross-section. It will be appreciated, however, that other numbers of side wall openings 126 may be formed in the side walls 122, and that other shapes and cross-sections are suitable for the side wall openings 126 and the tubular crossbar 112, such as oval, rectangular, triangular, hexagon, octagon, or other suitable shapes and cross-sections.

Referring to FIG. 12, an elongated tubular handle 114 has one end portion configured to be received and extend into the tubular member 116. The handle 114 has a through-hole 139 configured to be aligned with a through-hole 141 formed in the tubular member 116. As shown in FIGS. 10 and 12, a lock pin 140 is configured to extend through the aligned through-holes 139, 141 so securely removably connect the handle 114 to the tubular member 116. The handle 114 is relatively long, that is, preferably on the order of six or seven feet, for example, to provide maximum mechanical advantage for the user of the sheathing and decking remover 100, yet not so long that the remover becomes unwieldy to handle or cumbersome to store. Preferably, as shown in FIG. 12, the outer diameter of the crossbar 112 is less than the inner diameter of the handle 114 so that, when the remover 100 is not being used, the crossbar 112 may be removed therefrom and stored within the bore of the tubular handle 114, thereby reducing the overall width of the sheathing and decking remover 100 and increasing the storage capability of the remover 100. In the stored configuration, the crossbar 112 is supported within the bore of the tubular handle 114 by engagement between one of the depressible protrusions 113 of the crossbar 112 with an opening of the tubular handle 114, as described above for the embodiment of FIG. 7. Thus the bore of the tubular handle 114 and the engagement between the depressible protrusion 113 of the crossbar 112 and the opening of the handle 114 define means for storing the crossbar 112 during non-use of the remover 100. By this construction and corresponding functions, the present invention provides a remover that can be stored in the bore of the handle and which is readily accessible and movable from a storage position, during non-use of the remover, to a fulcrum generating or action position ready for performing a removal operation.

Figure 14:
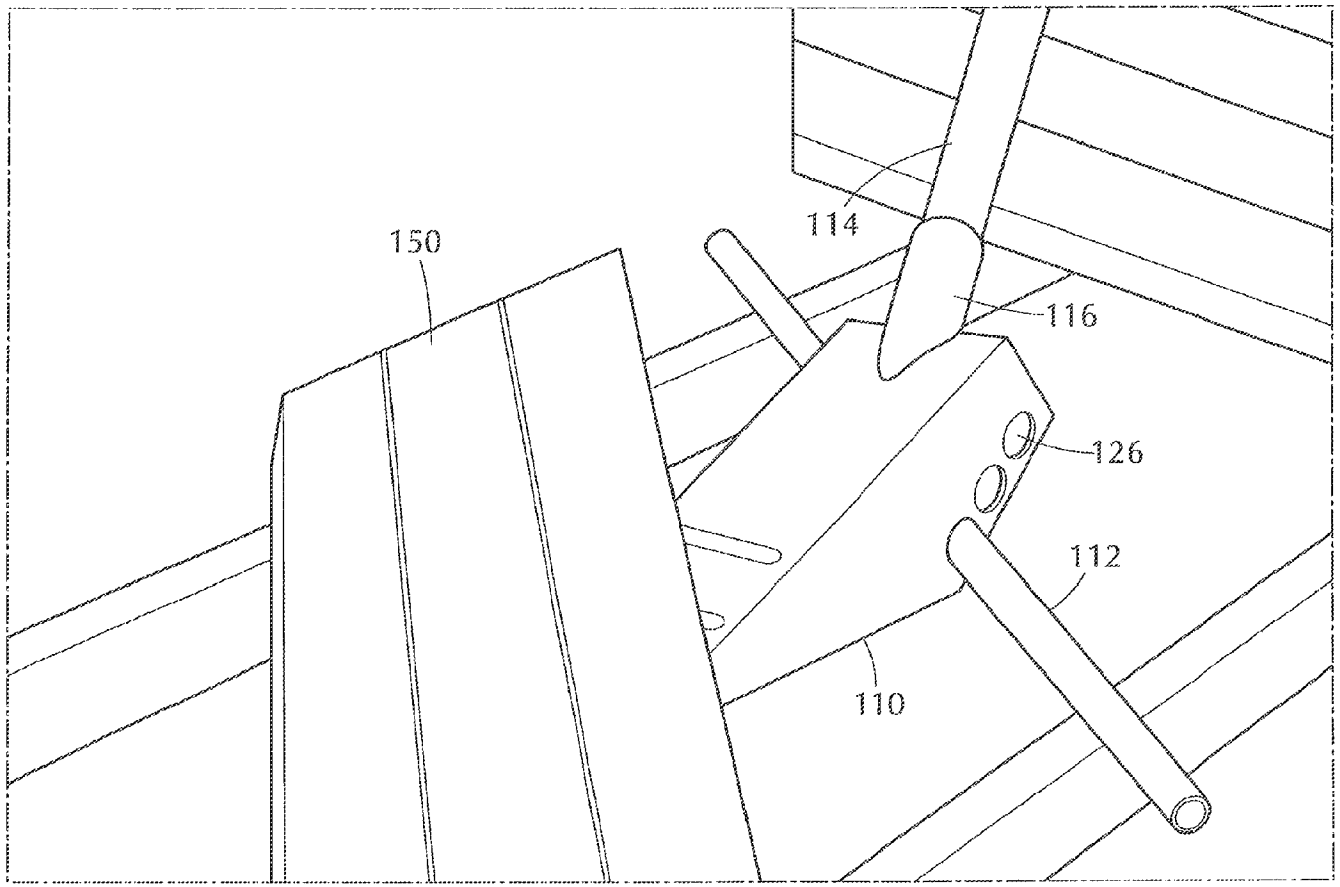
Figure 15:
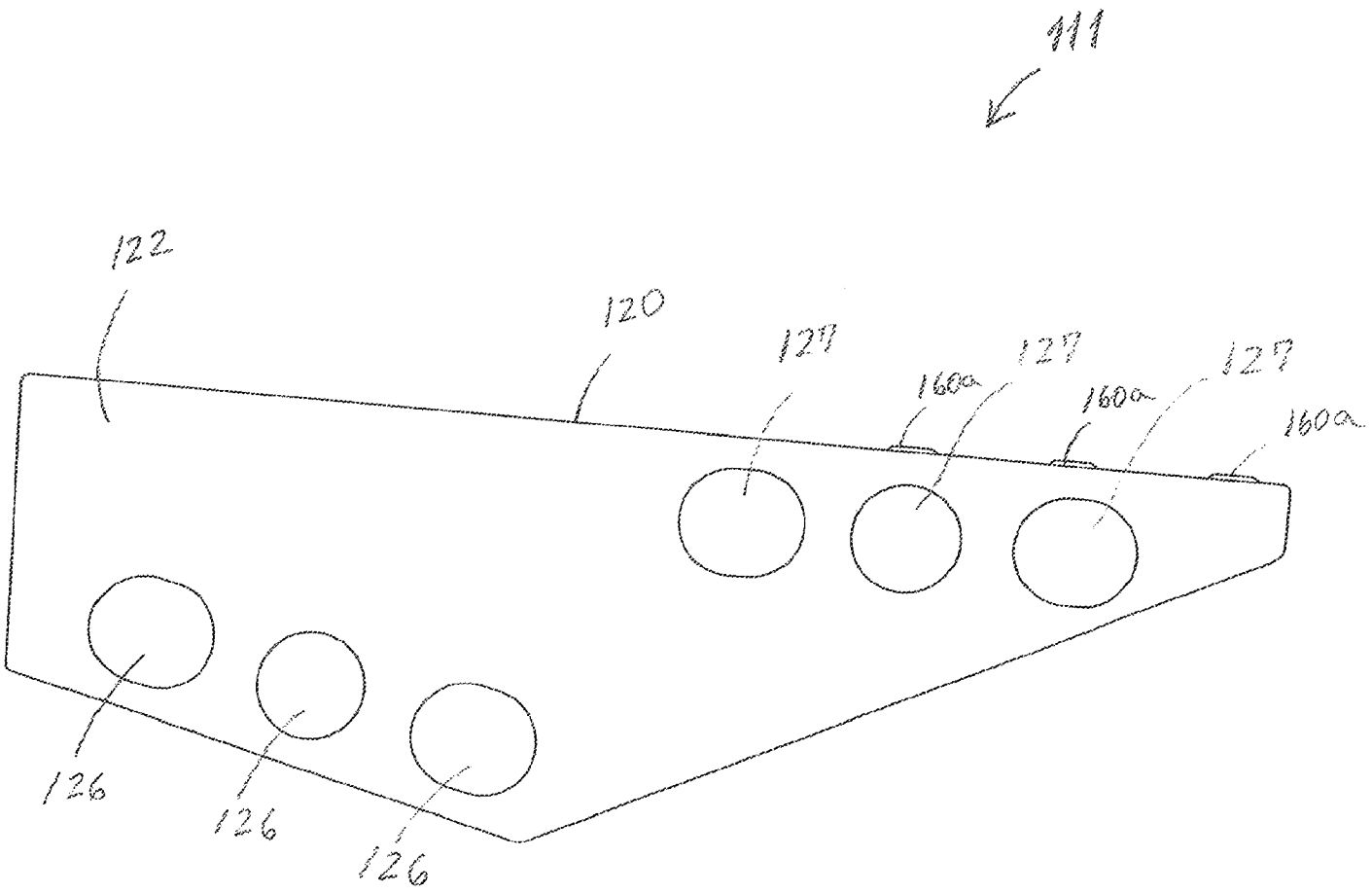
FIG. 15 is a side view of a modified pry box for the tool for removing sheathing and decking and the like according to the present invention.
Figure 16:
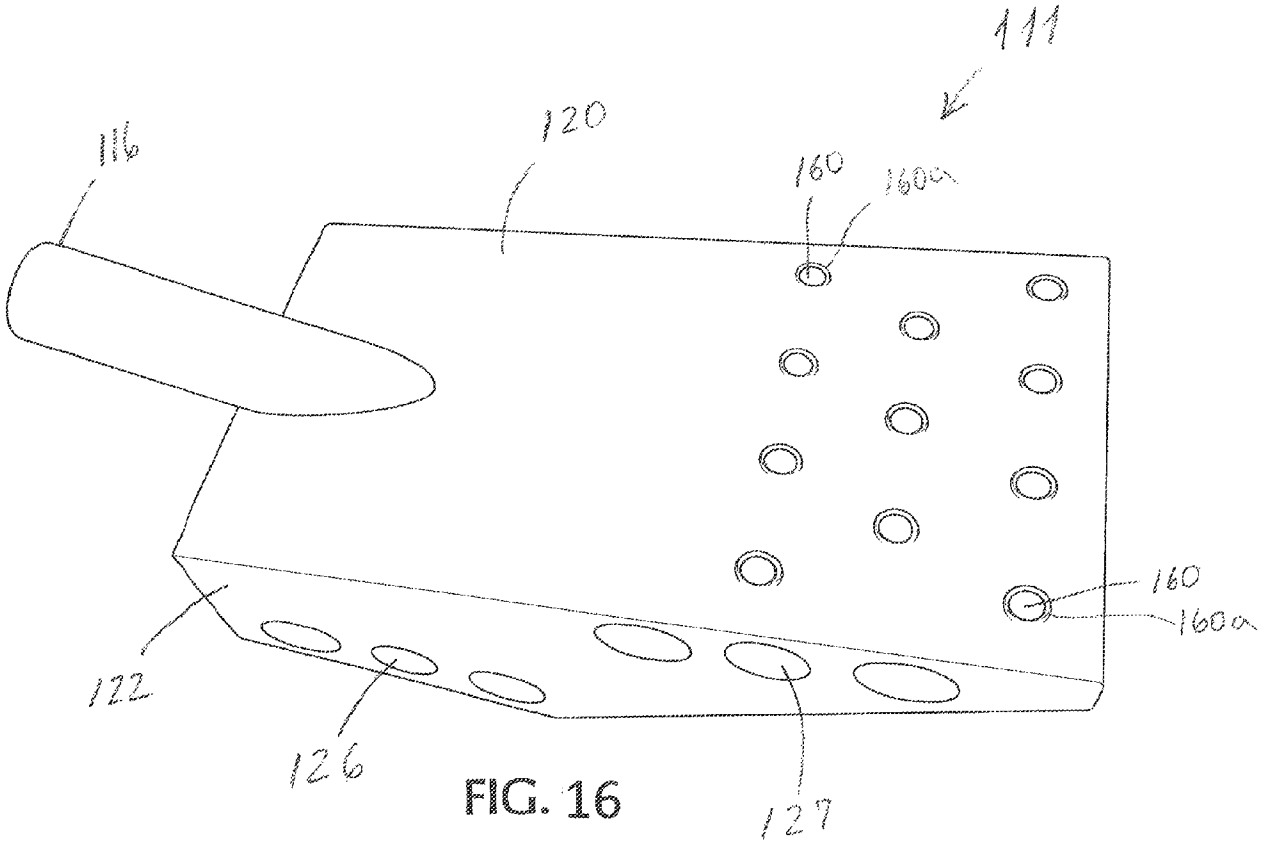
FIG. 16 is a perspective view of the modified pry box shown in FIG. 15.
Figure 17:
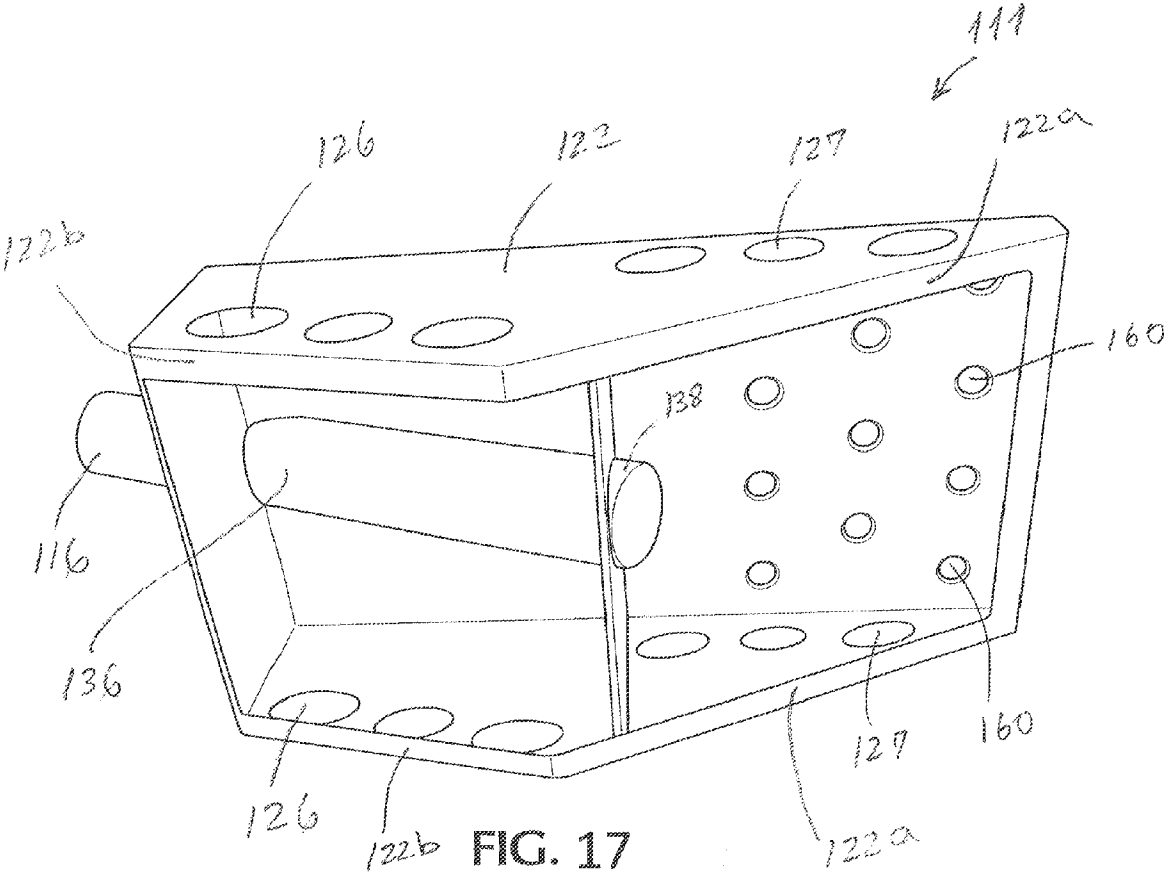
FIG. 17 is another perspective view of the modified pry box shown in FIG. 15.
Figure 18:
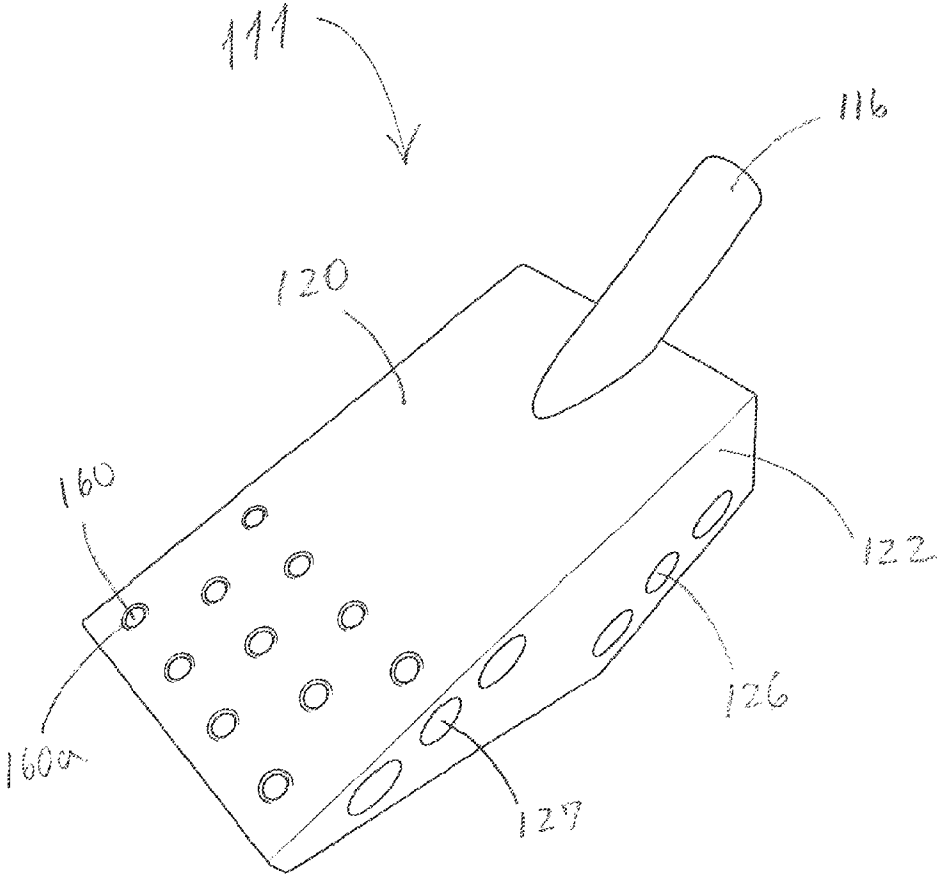
FIG. 18 is another perspective view of the modified pry box shown in FIG. 15.

FIG. 14 shows the remover 100 during a removal operation for removing sheathing or decking material 150. According to the embodiment of the remover shown in FIGS. 8-14, the multiple aligned openings 126 allow the crossbar 112 to be positioned at various angular and positional orientations relative to the pry box 110 and the tubular member 116 (and thus the handle 112), including the various orientations shown in FIG. 11 and, as such, increases the number of positions that the crossbar 112 can be placed within the sheathing or decking material to be removed, thereby providing a more efficient remover in terms of facilitating the amount of material that can be removed in a short period of time. Furthermore, during a removal operation the protrusions or gripping surfaces 128 come into contact with the sheathing or decking material 152, thereby providing a gripping surface that prevents the pry box 110 from slipping relative to the material 152.

FIGS. 15-18 show a modified form of the pry box 111 according to the present invention. The pry box 111 differs from the pry box 110 in FIGS. 8-14 in that the pry box 111 is further provided with a second set of aligned openings or holes 127 formed in the side walls 122 and disposed generally parallel to the bottom wall 120. The second set of side wall openings 127 are configured to receive therethrough the crossbar 112 as described above for the side wall openings 126. The second set of side wall openings 127 further increase the range of positions for the crossbar 112 relative to the pry box 111, as well as the angular orientation of the crossbar 112 relative to the tubular member 116 and the handle 114, thereby further facilitating removal of sheathing and decking material during a removal operation.

Another difference between the pry box 111 and the pry-box 110 is that the bottom wall 120 of the pry box 111 is further provided with multiple spaced-apart gripping members 160 that facilitate gripping of the sheathing and decking material during a removal operation. The gripping members 160 are formed as through-holes extending through the bottom wall 120 and include protruding portions 160*a* surrounding the circumferences of the respective through-holes. The gripping members 160 are particularly configured to prevent slippage between the pry box 111 and the material to be removed. By this construction, the safe operation of the remover is further enhanced. The materials and dimensions of the pry box 111 are as described above for the pry box 12 and 110.

Figure 19:
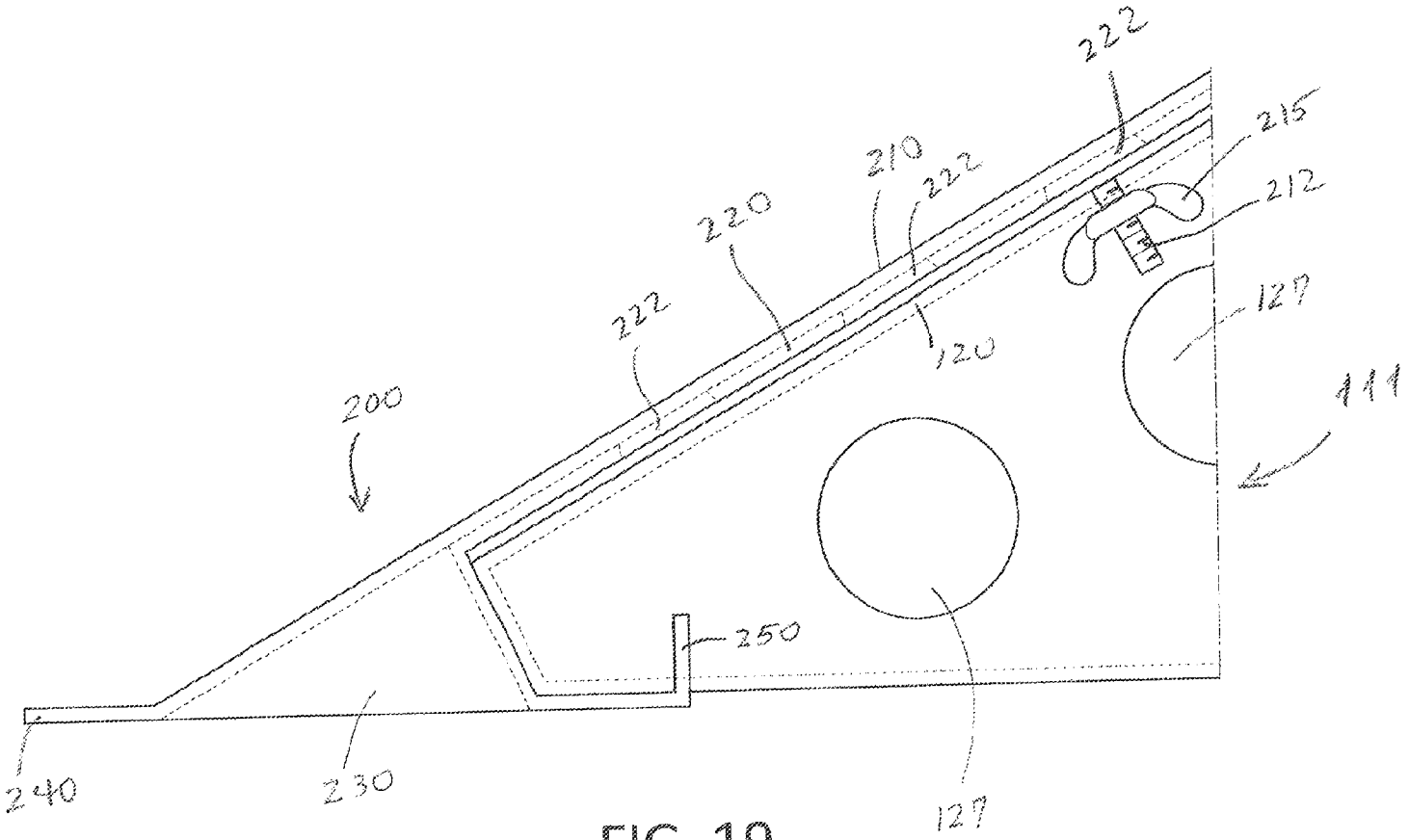
FIG. 19 is a side view of a ripping attachment for the tool for removing sheathing and decking and the like according to the present invention, showing the ripping attachment mounted on the tool.
Figure 20:
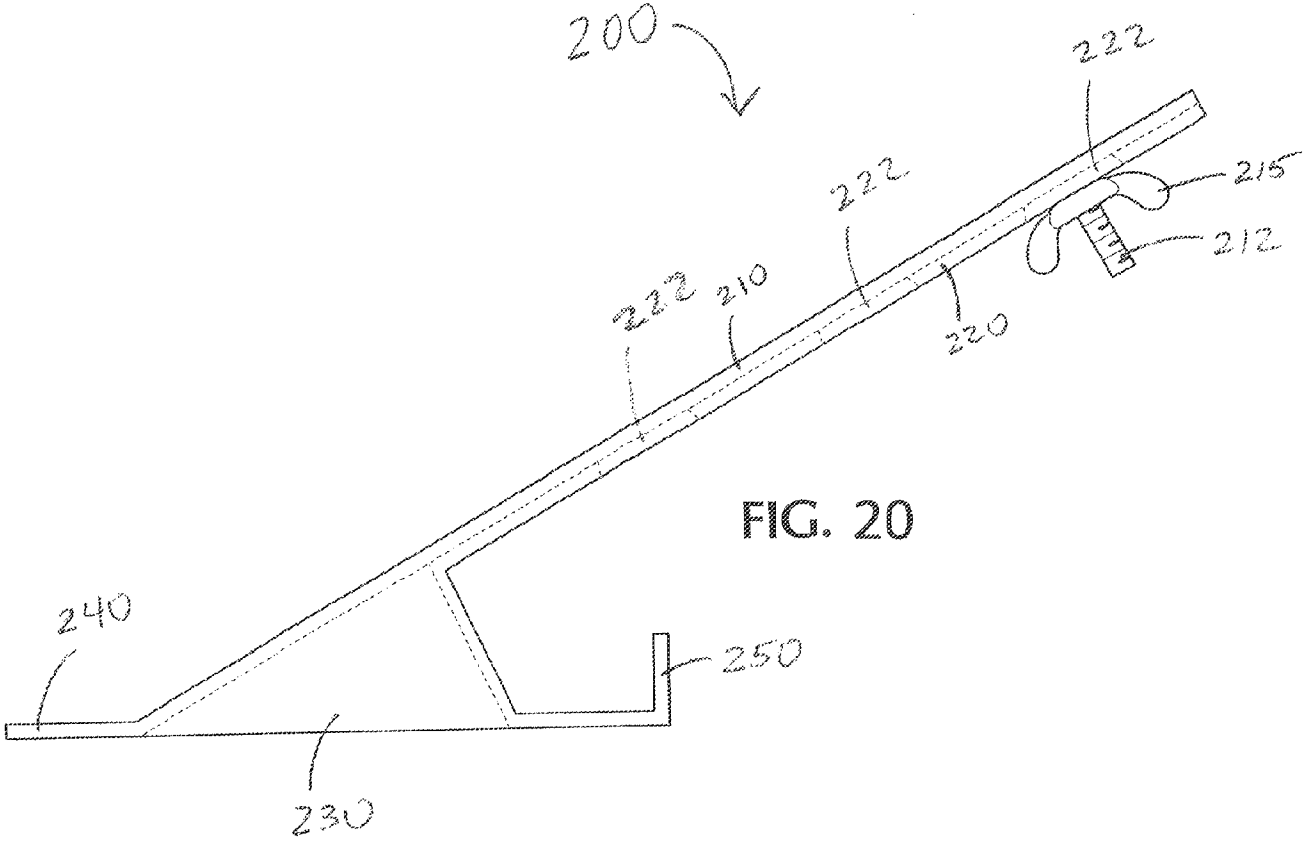
FIG. 20 is a side view of the ripping attachment of FIG. 19, showing the ripping attachment removed from the tool.
Figure 21:
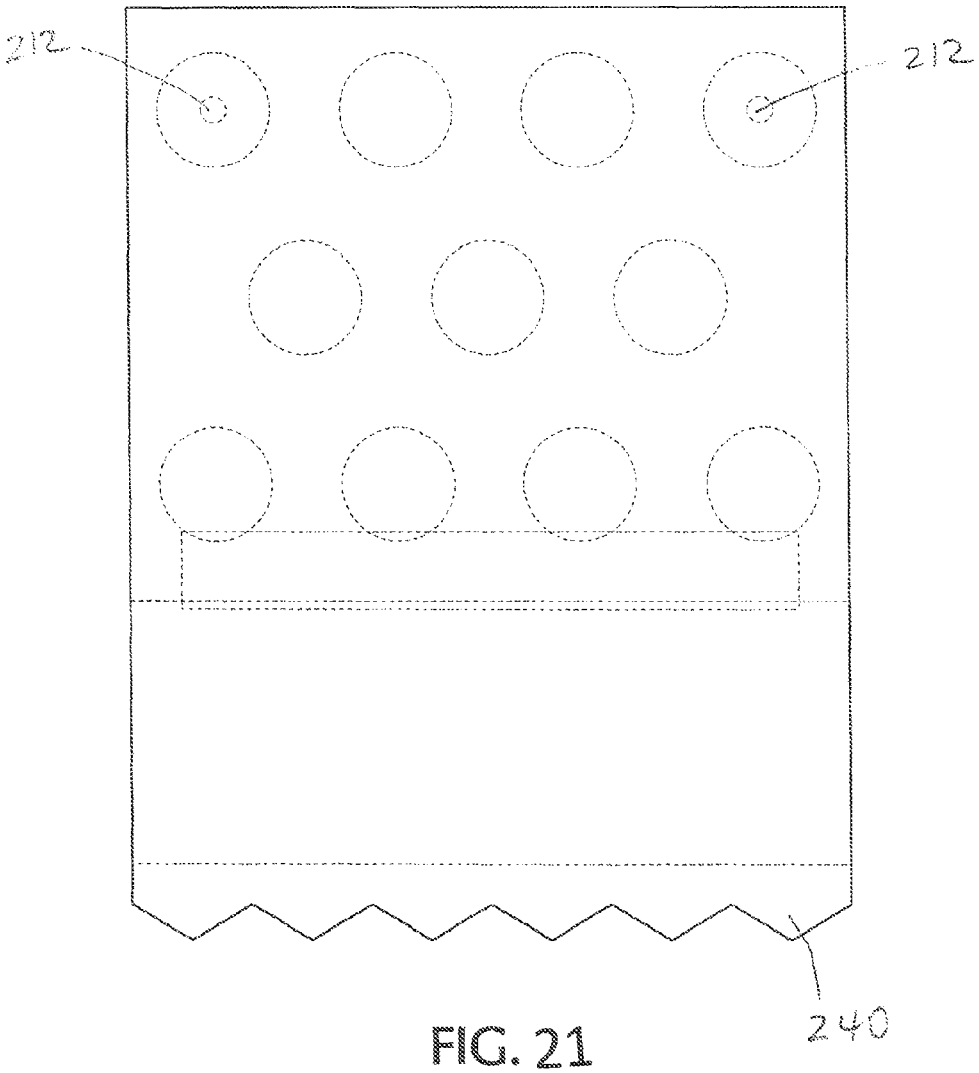
FIG. 21 is a top view of the ripping attachment.

FIGS. 19-21 show an exemplary embodiment of a ripping attachment 200 that is configured to be removably attached to the remover according to the present invention to further facilitate ripping and removal of material during a removing operation. In FIGS. 19 and 21, the ripping attachment is shown removably attached to the pry box 111 described above with reference to FIGS. 15-18.

Referring to FIG. 20, the ripping attachment 200 is preferably made of a steel material and includes top and bottom layers 210, 220 formed of flat plates integrally connected together, and a base portion 230 from which extend a ripping edge 240 and a hook or latch portion 250. The bottom layer 220 has a plurality of relief holes 222 corresponding in number to the number of grip holes 160 formed on the bottom wall 120 of the pry box 111. When the ripping attachment 200 is attached to the pry box 111, the relief holes 222 are configured to be laid over and aligned with the respective grip holes 160 such that the relief holes 222 receive the respective protrusions 160*a* of the grip holes 160 so that the top and bottom layers 210, 220 of the ripping attachment is integrally mounted to the bottom wall 120 of the pry box 111, as shown in FIGS. 19 and 21.

The top layer 210 is provided with a pair of threaded studs 212 (connecting elements) configured to respectively extend through two of the grip holes 160 when the ripping attachment is mounted to the pry box 111. In this configuration, each of the threaded studs 212 is threadedly engaged with a wing nut 215 (connecting element) which are threadedly engaged to bring the top and bottom layers 210, 220 of the ripping attachment 200 into firm contact with the bottom wall 120 of the pry box 111 while relief holes 222 receive the respective protrusions 160*a* of the grip holes 160, as shown in FIG. 19. By this construction, the ripping attachment 200 is integrally removably mounted to the pry box 111

The ripping edge 240 extends from one side of the base portion 230 and the latch portion 250 extends from an opposite side of the base portion 230. The latch portion 250 is generally L-shaped and is configured to firmly engage the front wall 124 of the pry box 111 when the ripping attachment is mounted on the pry box 111.

According to the present invention, the ripping attachment 200 can be readily and securely mounted on the pry box 111 during a removing operation to further facilitate ripping of various types of materials. For example, the ripping attachment 200 is particularly adapted for ripping hardwood. The ripping attachment 200 can also be readily removed from the pry box when the remover is desired to be used without the ripping attachment.

The remover according to each of the foregoing embodiments of the present invention, because of the mechanical advantage it provides and its construction, removes sheathing and decking and like materials from a building construction quickly and easily, and without requiring any excessive force. In particular, by providing the pry box with a front wall forming a narrow shovel nose, the remover can effectively be inserted into tight and narrow spots requiring removal of sheathing and decking material and the like. Thus, the sheathing and decking remover of the present invention minimizes or eliminates any muscle strain or back injury to the user of the remover which may have otherwise resulted from conventional methods and equipment. Removal of sheathing and decking material and the like using the remover of the present invention requires less time and lowers construction costs as compared to the conventional methods and equipment. These advantageous effects are particularly enhanced by providing the pry box with one or multiple sets of aligned side wall holes or openings for receiving and positioning the crossbar in multiple angular configurations relative to the pry box as described above with reference to FIGS. 8-18, and by use of the detachable ripping attachment as described above with reference to FIGS. 19-21.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

I claim:

1. A tool for removing sheathing and decking material, the tool comprising:

a head having a rear end, front end, a bottom wall, a pair of opposite lateral side walls connected to and extending from opposite edges of the bottom wall and having a plurality of pairs of aligned holes, a rear wall disposed at the rear end and connected to the bottom wall and the side walls, a front wall disposed at the front end and connected to and extending between the bottom wall and the side walls, an interior space defined by the bottom, side, rear and front walls, a support wall disposed in the interior space and extending between and connected at opposite edges thereof to the side walls, and a tubular member integrally connected to the rear wall and the support wall;

a handle configured to extend into and be removably connected to the tubular member of the head; and a fulcrum member configured to be selectively removably received by one of the plurality of pairs of aligned holes formed in the side walls of the head so that the fulcrum member extends in a preselected angular orientation relative to the handle during a removal operation.

2. The tool according to claim 1; wherein the tubular member projects rearwardly from the rear wall of the head.

3. The tool according to claim 1; wherein the tubular member extends through openings formed in the rear wall and the support wall of the head.

4. The tool according to claim 1; wherein the side walls have first edges sloped from the support wall downwardly towards the front wall, and second edges sloped from the support wall downwardly toward the back wall.

5. The tool according to claim 4; wherein the plurality of pairs of aligned holes are disposed generally parallel to the second edges of the side walls.

6. The tool according to claim 1; further comprising a plurality of protrusions formed on the bottom wall of the head for providing a gripping surface for gripping the material to be removed during a removal operation.

7. The tool according to claim 1; wherein the head is formed of sheet metal.

8. The tool according to claim 1; wherein the handle is tubular in construction and has a bore configured receive and store therein the fulcrum member.

9. The tool according to claim 1; further comprising a plurality of gripping members formed on the bottom wall of the head and having respective protruding portions configured to facilitate gripping of the material during a removal operation.

10. The tool according to claim 9; further comprising a ripping attachment configured to be removably mounted to the head for ripping material during a removal operation, the ripping attachment having a plurality of relief holes configured to receive the respective protruding portions of the gripping members when the ripping attachment is mounted to the head, and a ripping edge for ripping material during a removal operation.

11. The tool according to claim 10; wherein the ripping attachment comprises a pair of flat plates integrally connected together, a base portion from which the ripping edge extends, and a hook portion extending from the base portion and configured for engagement with the front wall of remover, one of the pair of flat plates having the relief holes and the other of the pair of flat plates having at least one connecting element configured for connection to another connecting element to integrally removably mount the ripping attachment to the head.

12. A tool for removing sheathing and decking material, the tool comprising:

a head having a rear end, front end, a bottom wall, a pair of opposite lateral side walls connected to and extending from opposite edges of the bottom wall, a rear wall disposed at the rear end and connected to the bottom wall and the side walls, a front wall disposed at the front end and connected to and extending between the bottom wall and the side walls, an interior space defined by the bottom, side, rear and front walls, a support wall disposed in the interior space and extending between and connected at opposite edges thereof to the side walls, and a tubular member integrally connected to the rear wall and the support wall;

a first set of plural pairs of aligned holes formed in the side walls and extending along upper edges of the side walls;

a second set of plural pairs of aligned holes formed in the side walls and extending along the bottom wall;

a handle configured to extend into and be removably connected to the tubular member of the head; and a fulcrum member configured to be selectively removably received by one of the plurality of pairs of aligned holes of one of the first and second sets of plural pairs of aligned holes formed in the side walls of the head so that the fulcrum member extends in a preselected angular orientation relative to the handle during a removal operation.

13. The tool according to claim 12; wherein the tubular member projects rearwardly from the rear wall of the head.

14. The tool according to claim 12; wherein the tubular member extends through openings formed in the rear wall and the support wall of the head.

15. The tool according to claim 12; wherein the side walls have first edges sloped from the support wall downwardly towards the front wall, and second edges corresponding to the upper edges and sloped from the support wall downwardly toward the back wall.

16. The tool according to claim 15; wherein the first set of plural pairs of aligned holes are disposed generally parallel to the second edges of the side walls; and wherein the second set of plural pairs of aligned holes are disposed generally parallel to the bottom wall.

17. The tool according to claim 12; wherein the handle is tubular in construction and has a bore configured receive and store therein the fulcrum member.

18. The tool according to claim 12; further comprising a plurality of protrusions formed on the bottom wall of the head for providing a gripping surface for gripping the material to be removed during a removal operation.

19. The tool according to claim 12; further comprising a ripping attachment configured to be removably mounted to the head for ripping material during a removal operation, the ripping attachment having a plurality of relief holes configured to receive the respective protruding portions of the gripping members when the ripping attachment is mounted to the head, and a ripping edge for ripping material during a removal operation.

20. The tool according to claim 19; wherein the ripping attachment comprises a pair of flat plates integrally connected together, a base portion from which the ripping edge extends, and a hook portion extending from the base portion and configured for engagement with the front wall of remover, one of the pair of flat plates having the relief holes and the other of the pair of flat plates having at least one connecting element configured for connection to another connecting element to integrally removably mount the ripping attachment to the head.

* * * * *